United States Patent [19]

Zulauf et al.

[11] Patent Number: 4,712,593

[45] Date of Patent: Dec. 15, 1987

[54] APPARATUS FOR THE METERED REMOVAL OF PASTY OR FLUID SUBSTANCES

[75] Inventors: Karlheinz Zulauf, Höchst-Hassenroth; Lothar Breuer, Klein-Bieberau, both of Fed. Rep. of Germany

[73] Assignee: Wella Aktiengesellschaft, Darmstadt, Fed. Rep. of Germany

[21] Appl. No.: 796,486

[22] Filed: Nov. 6, 1985

Related U.S. Application Data

[63] Continuation of Ser. No. 577,122, Feb. 6, 1984, abandoned.

[30] Foreign Application Priority Data

Mar. 18, 1983 [DE] Fed. Rep. of Germany ..... 3309692

[51] Int. Cl.[4] ..... B65B 3/04

[52] U.S. Cl. ..... 141/113; 141/258; 141/357; 222/135; 222/386; 222/521

[58] Field of Search ..... 222/386; 141/113

[56] References Cited

U.S. PATENT DOCUMENTS

| | | | |
|---|---|---|---|
| 1,241,352 | 9/1917 | Doering et al. | 222/490 |
| 2,085,446 | 6/1937 | Philippe | 222/386 |
| 2,518,751 | 8/1950 | Carlton | 222/424.5 |
| 2,628,743 | 2/1953 | Newlyn | 222/135 |
| 3,194,453 | 7/1965 | Cherba | 222/521 |
| 4,294,293 | 10/1981 | Lorenz et al. | 141/100 |
| 4,473,097 | 9/1984 | Knickerbocker et al. | 222/215 |

FOREIGN PATENT DOCUMENTS 2827610 1/1980 Fed. Rep. of Germany .

*Primary Examiner*—Joseph J. Rolla
*Assistant Examiner*—Michael S. Huppert
*Attorney, Agent, or Firm*—Michael J. Striker

[57] ABSTRACT

Apparatus for the metered removal of a pasty or fluid substance and including a storage container for the pasty or fluid substance and having an interior with a constant internal cross section, an upper end with an outlet nozzle, and a body having an opened lower end, a plunger disposed in the body of the storage container and being upwardly displaceable to exert a feed pressure on the interior of the storage container, and a piston rod for actuating the plunger and having a support foot projecting from below into the storage container and bearing removably on the plunger.

4 Claims, 8 Drawing Figures

APPARATUS FOR THE METERED REMOVAL OF PASTY OR FLUID SUBSTANCES

This application is a continuation of application Ser. No. 577,122 filed Feb. 6, 1984, now abandoned.

BACKGROUND OF THE INVENTION

The invention relates to an apparatus for the metered removal of pasty or fluid substances from a storage container having an outlet nozzle which is disposed at the upper container end and can be introduced into a self-closing bottom valve of a mixing container, and having a plunger which can be actuated by a piston rod to exert a feed pressure on the interior of the storage container.

Apparatus of this type are used for example for cosmetic preparations, in particular hair dyes and for mixing their components. In this connection there are many storage containers available from which the substances to be mixed are to be removed and introduced successively into a mixing container. Some of the substances have a strong colouring effect or react chemically with one another or with the atmospheric oxygen, should be removed so that there are as few losses as possible and should be introduced directly into the mixing container so as to avoid contamination.

In the case of a known apparatus of the initially mentioned type (German specification No. 28 27 610) a piston feed pump is arranged in the storage container and has its piston cylinder screwed to the storage container. A hollow piston rod, connected to the plunger, projects out of the piston cylinder and bears the outlet nozzle at its upper end. The mixing container is placed with its self-closing bottom valve on this nozzle; a pressure is exerted on the piston rod and thus on the plunger in order to convey the substance to be removed, which may be pasty or fluid, upwards into the mixing container.

The structural expenditure required in this connection for each individual storage container is comparatively great since each storage container has to have its own pump which in each case contains two non-return valves and a spring. These parts are in constant contact with the substance to be conveyed. At the end of the removal process a relatively large amount of the substance remains in the piston cylinder and on the piston rod; these lost amounts can no longer be conveyed.

SUMMARY OF THE INVENTION

What is desired is a storage container of the initially mentioned type having a construction which is as simple as possible and which, apart from a slight residual amount, can be emptied, whilst enabling discharge to be performed simply.

In accordance with the present invention the body of the storage container forms the piston cylinder, which is open at its lower end, and the piston rod provided with a support foot projects from below into the storage container and is removably supported on the plunger.

The apparatus is thus of a very simple construction. In principle it consists of a piston cylinder (i.e. a hollow body of constant internal cross-section) which simultaneously forms the storage container and is provided at its upper end with the outlet nozzle, as well as the plunger which is displaceable in the piston cylinder and is constructed as a very simple structural component, namely as a container base displaceable in the piston cylinder.

The piston rod is constructed separately from the storage container. It is not replaced when the storage container is replaced. It forms the take-up support and also the piston cylinder guide. With a stable arrangement of the piston rod, therefore, there is also no risk of the storage container tipping over during the removal process, so that contamination is avoided.

In order to exclude the possibility of a chemical reaction between the substance to be removed and the atmospheric oxygen during relatively long contact periods and with unintentional pressing of the substance out of the storage container when the mixing container is not mounted, the outlet nozzle of the storage container is preferably provided with a closure valve which is actuatable by rotational movement of a valve actuation cap relative to the storage container. In this way the storage container can be closed after each removal or at least when no removal is intended for a relatively long period of time.

It has proved particularly advantageous to mount a plurality of piston rods on one common base plate. Thus a plurality of storage containers are available in orderly association on a common carrier, as a result of which the alternating removal from a plurality of storage containers is substantially facilitated.

In a particularly preferred embodiment it is provided that each piston rod is arranged coaxially and at a radial spacing in a substantially cylindrical piston rod chamber and that at least one straight guide is provided in the wall of the piston rod chamber and is in engagement with the storage container. In this connection, the storage container can be lowered with respect to the piston rod during the removal process but it is retained against rotation, such that the rotary actuation of the valve actuation cap of the closure valve can be performed with one hand or even with the mounted mixing container, without the storage container itself having to be retained in a particular manner.

A construction of this straight guide which is particularly simple from a structural point of view consists of at least one longitudinal groove being provided in the wall of the piston rod chamber, into which groove a radial projection of the storage container protrudes.

BRIEF DESCRIPTION OF THE DRAWINGS

The invention will be described further, by way of example, with reference to the accompanying drawings, in which.

DETAILED DESCRIPTION OF THE PREFERRED EMBODIMENT

Figure 1:
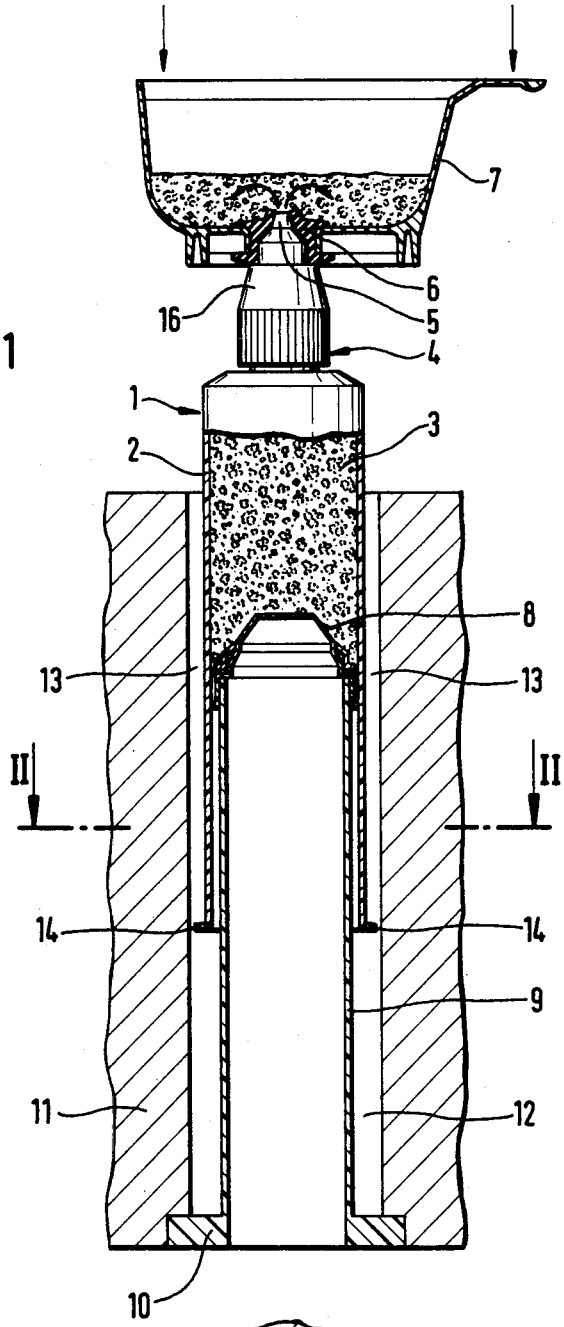
FIG. 1 is a longitudinal section of a storage container with a mounted mixing container, the storage container being arranged in a piston rod chamber of a base plate, only part of which is shown.
Figure 2:
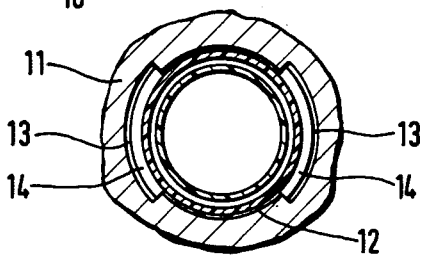
FIG. 2 is a section on line II—II in FIG. 1.

The storage container 1 shown in FIG. 1 comprises a piston cylinder 2 which forms the body of the container 1 and is filled with a pasty or fluid substance 3 to be removed, for example a hair dye. The upper end of the cylinder 2 is closable by means of a closure valve 4 which bears an outlet nozzle 5 at its upper end. The nozzle 5 can be inserted in a self-closing bottom valve 6 of a mixing container 7 in the manner shown in FIG. 1.

The cylinder 2 contains a plunger 8 which is guided in a sealing manner by the inner wall of the cylinder 2 and forms the container base. The cylinder 2 is open at the bottom. Into the opening formed in this way projects a piston rod 9 which, in the embodiment shown, consists of a pipe comprising at its lower end a support foot 10 which is anchored in a base plate 11. The piston rod 9 and the container 1 inverted thereover are accommodated in a piston rod chamber 12 of the base plate 11. Two opposite, wide, longitudinal grooves 13 are hollowed out in the wall of the piston rod chamber 12 and a respective radial projection 14 disposed at the lower end of the cylinder 2 projects into each of these grooves 13. The projections 14 protruding into the longitudinal groove 13 form a straight guide for the container 1 with respect to the base plate 11. The container 1 can be freely removed upwardly from the piston rod chamber 12, for example in order to be replaced, after it has been completely emptied, by a new, full storage container.

Figure 3:
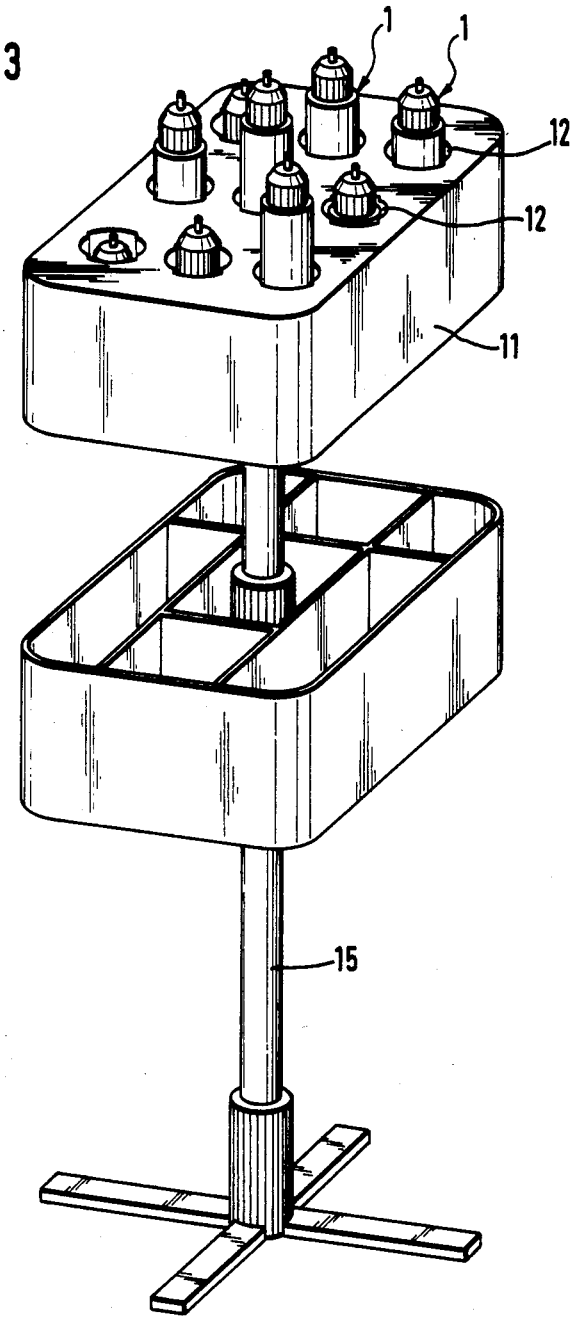
FIG. 3 is a perspective view of a stand bearing a base plate in which a plurality of storage containers according to FIG. 1 are arranged.

As FIG. 3 shows, the base plate 11 has a support foot 15 and accommodates a plurality of storage containers 1 in a plurality of piston rod chambers 12. Containers 1 in the embodiment illustrated are filled to varying degrees and therefore project at varying heights out of the base plate 11.

Figure 4:
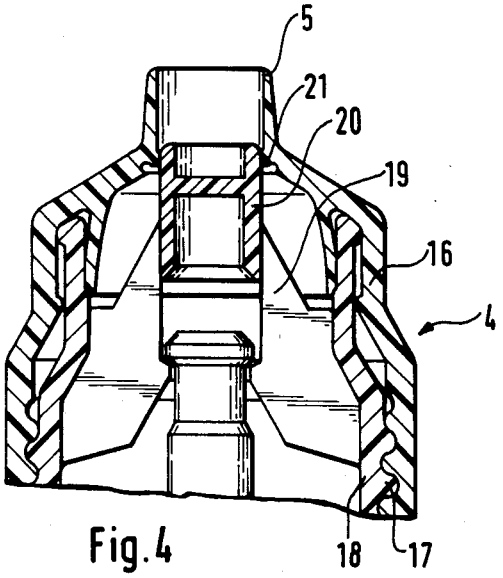
FIG. 4 is an enlarged longitudinal section through the closure valve on the removal nozzle of the storage container and which is in the close position.
Figure 5:
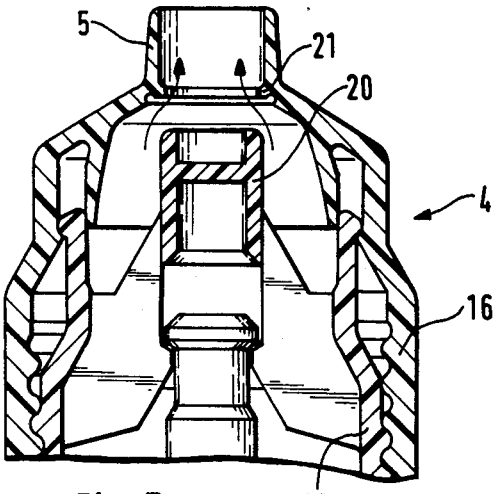
FIG. 5 shows the closure valve according to FIG. 4 in the open position.

The storage container closure 4—details of which are shown in FIGS. 4 and 5—comprises a valve actuation cap 16 whose upper end forms the outlet nozzle 5. The cap 16 is connected to a threaded attachment 18 of the cylinder 2 via a screwthread 17. The attachment 18 bears via crosspieces 19 a central closure member 20, against which an inwardly projecting sealing lip 21 of the nozzle 5 abuts in the closed state (FIG. 4).

When the valve actuation cap 16 is rotated with respect to the threaded attachment 18 by an amount limited by stops, the sealing lip 21 is raised from the closure member 20 and frees an annular outlet cross-section. In this open position (FIG. 5) the substance to be removed can emerge from the nozzle 5 around the closure member 20 in the manner indicated by arrows in FIG. 5.

In order that the closure valve 4 can be actuated with only one hand, the cylinder 2 is secured against rotation by the above-described straight guide in the piston rod chamber 12.

Figure 6:
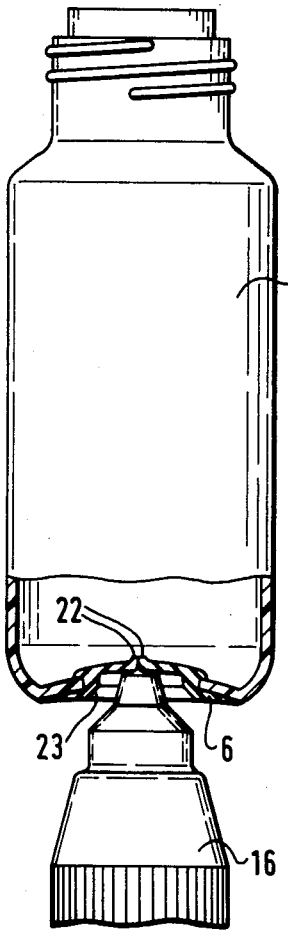
FIG. 6 shows a bottle-like mixing container before mounting on the nozzle of the storage container.
Figure 7:
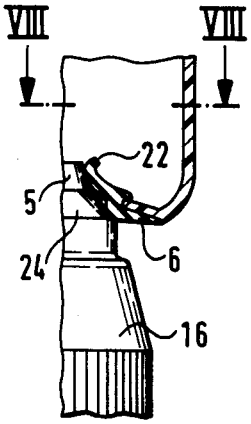
FIG. 7 is a partial view similar to FIG. 6 of the bottom valve of the mixing container after mounting on the nozzle of the storage container.
Figure 8:
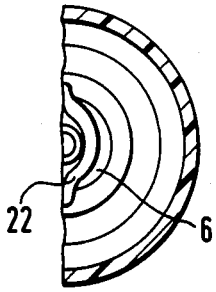
FIG. 8 is a section on line VIII—VIII in FIG. 7.

In the embodiment shown, the self-closing bottom valve 6 of the mixing container 7 is produced in one piece from an elastomer and forms a sealing lip valve comprising two sealing lips 22 which abut against one another along a center plane in the closed state (FIG. 6). When the nozzle 5 is inserted in the valve 6 (FIG. 7) it urges the two lips 22 apart and thus opens the valve 6.

An annular sealing seat 23 is arranged concentrically to the central axis of the valve 6, below the lips 22, and is supported in a sealing manner on a corresponding (for example conical) sealing seat 24 below the nozzle 5 and forms a continuous closed seal during the removal process.

We claim:

1. Apparatus for the metered removal of a pasty or fluid substance, comprising:

a storage container for the pasty or fluid substance having a cylindrical body with an opened lower end and an upper end, and an outlet nozzle for discharge of the substance disposed at said upper end;

a plunger disposed in said body of said storage container and being upwardly displaceable relative to said storage container to exert a feed pressure on said body of said storage container;

a piston rod for actuating said plunger and having a support foot integral with the piston rod projecting from below into said storage container and bearing removably on said plunger;

a base plate containing a substantially cylindrical chamber which receives said piston rod, the support foot of which is anchored in said base plate, said cylindrical chamber receiving said piston rod, said plunger and said storage container so that they are coaxial and concentrical with each other and said base plate;

a mixture container positioned exteriorly of said base plate and having a one piece self-closing bottom valve into which said outlet nozzle of said storage container is insertable, said bottom valve being openable upon insertion of said outlet nozzle to discharge the substance into said mixing container and closeable upon removal therefrom to prevent leakage of the substance from said mixing container by an annular sealing seat for said outlet nozzle;

a closure valve disposed within said outlet nozzle of said storage container and having a valve actuation cap arranged to actuate said closure valve by rotational movement relative to said storage container, said closure valve being closable by rotation of said valve actuation cap so that after removal of said outlet nozzle from said self-closing bottom valve the substance in said storage container is sealed from contamination, said valve actuation cap having an exterior conical sealing seat which communicates with said self closing bottom valve of said mixing container to form a continuous closed seal during discharge of the substance into said mixing container; and straight guide means for guiding said storage container in said chamber.

2. The apparatus as defined in claim 1; further comprising a plurality of such piston rods, and a common base plate to which said plurality of piston rods are mounted.

3. The apparatus as defined in claim 2, wherein said piston rod chamber has a wall that cooperates with said storage container in forming said straight guide means.

4. The apparatus as defined in claim 3, wherein said straight guide means includes at last one longitudinal groove disposed in said wall of said piston rod chamber and at least one radial projection on said storage container protruding into said at least one longitudinal groove disposed in said wall of said chamber.

* * * * *